United States Patent [19]

Apissomian

[11] 4,411,468

[45] Oct. 25, 1983

[54] ROCKING CHAIR

[75] Inventor: Arthur A. Apissomian, Wadena, Minn.

[73] Assignee: Homecrest Industries Incorporated, Wadena, Minn.

[21] Appl. No.: 240,772

[22] Filed: Mar. 5, 1981

[51] Int. Cl.[3] ..... A47C 3/02

[52] U.S. Cl. ..... 297/264; 248/630

[58] Field of Search ..... 248/626, 627, 630; 297/268, 264, 302, 303, 345, 349, 346

[56] References Cited

U.S. PATENT DOCUMENTS

| | | | |
|---|---|---|---|
| 163,287 | 5/1875 | Wheeler . | |
| 955,220 | 4/1910 | Stewart . | |
| 2,155,234 | 4/1939 | Meisse | 248/626 X |
| 2,163,078 | 6/1939 | Zerbee . | |
| 2,704,112 | 3/1955 | Rice | 248/626 X |
| 4,119,343 | 10/1978 | Pentzien | 297/264 |
| 4,141,530 | 2/1979 | Ward . | |
| 4,236,752 | 12/1980 | Mizelle | 297/268 X |

FOREIGN PATENT DOCUMENTS

| | | | |
|---|---|---|---|
| 2064843 | 6/1972 | Fed. Rep. of Germany | 297/264 |
| 1046574 | 10/1966 | United Kingdom | 297/302 |

*Primary Examiner*—J. Franklin Foss

*Attorney, Agent, or Firm*—Kinney, Lange, Braddock, Westman and Fairbairn

[57] ABSTRACT

A rocking chair of the type employing a flexure member formed of a flat, fiber reinforced material for supporting a chair seat with respect to a chair base in which the support means for supporting the flexible sheet member from the chair base has a flat surface to which the sheet member is secured and an aperture above the flat surface through which the sheet member extends, the opposed walls of the aperture diverging from top to bottom to allow flexing of the sheet member with the effective length of the flexure member decreasing as the chair is rocked rearwardly. The sheet member is preferably disposed at an angle to the vertical of between five and fifteen degrees, to impart an initial bias on the sheet member. The rear wall of the aperture is curved to allow a greater length of the sheet member to flex as the chair is rocked rearwardly.

10 Claims, 8 Drawing Figures

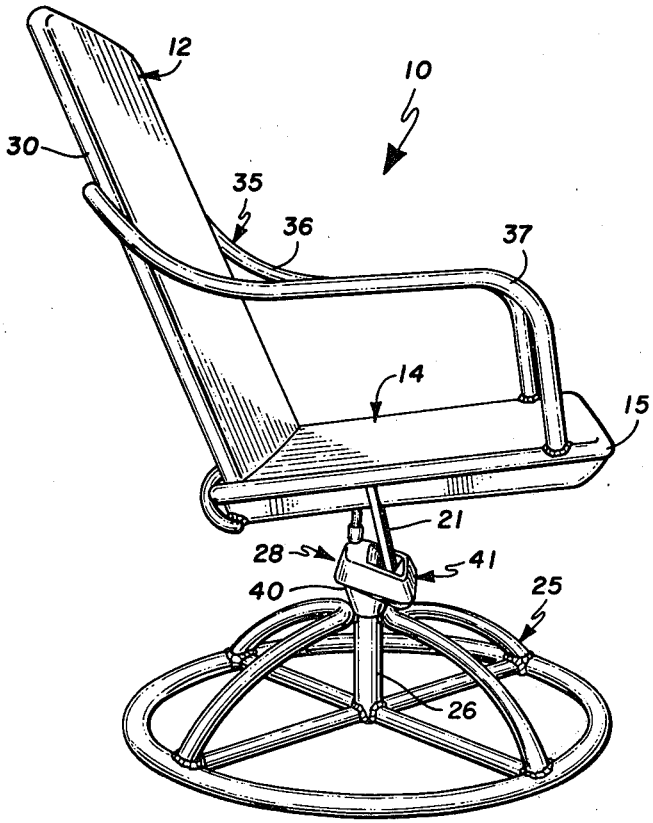

ROCKING CHAIR

BACKGROUND OF THE INVENTION

It has recently been proposed to provide a rocking chair in which the member supporting the chair from the chair base is a flexible plastic sheet means which is connected at one end to the chair and at the opposite end to the chair base. This flexible sheet means may be in the form of a fiber reinforced plastic material, the reinforcing fibers preferably consisting of continuous glass filaments. It has been found that this sheet material provides a smooth rocking action. Furthermore, it is extremely inexpensive to manufacture a chair employing such a sheet of flexible plastic material as the chair seat supporting means.

Several patents have issued in recent years directed to such chairs. One such patent is the Pentzien U.S. Pat. No. 4,119,343 in which the flexible sheet means are disposed in various manners. In one case, the sheet means is disposed at an angle of almost 45°. In another, it is disposed vertically.

Another patent somewhat similar to the Pentzien patent is the Ward U.S. Pat. No. 4,141,530. This patent likewise shows various embodiments, in some of which the flexible strip is disposed at an angle of nearly 45° and another in which the flexible strip is disposed vertically.

There are several problems in connection with constructions such as shown in the Ward and Pentzien patents. If the strip is disposed vertically, the chair tends to be unstable about its normal position. In other words, very little rocking force is required to cause the chair to move either forward or back. On the other hand, if the flexible strip is disposed at an angle such as 45°, there is a very substantial vertical bending force applied to the strip, placing it under very large bending force.

Another drawback to the arrangements of the Pentzien and Ward patents is that there is no effective stop means to limit the flexure of the strip. It is highly desirable with a flexible plastic spring member such as employed in this type of chair for there to be some means for limiting the rocking motion in both the forward and rearward directions.

In the pending application of Donald L. Bottemiller and John K. Miles, Ser. No. 164,824, filed June 30, 1980, which has matured into U.S. Pat. No. 4,371,142, dated Feb. 1, 1983. there is disclosed a chair of the general type employing a flexible plastic spring member for supporting the chair seat from the chair base in which the flexible strip is inclined rearwardly at a slight angle. The angle with respect to the vertical is sufficiently small that the force applied to the strip is basically a vertical force. At the same time, the angle of inclination is sufficiently large that a slight bias is applied to the strip eliminating the unstable condition which exists when the strip is vertical. In addition, the structure shown in the aforesaid application of Donald L. Bottemiller and John Miles provides a stop means which effectively limits the rearward movement of the chair, thus limiting the rearward flexure.

SUMMARY OF THE INVENTION

The present invention is concerned with an improved chair of the type shown in the aforesaid application of Donald L. Bottemiller et al. in providing an improved means for securing the flexible strip to the chair base so as to provide for the effective length of the spring decreasing as the chair is rocked rearwardly. This is highly desirable since, as the chair is rocked rearwardly, the force opposing the rocking should progressively increase. The sheet member is preferably secured at a slight angle to the rear, preferably between 5° and 15° to impart an initial bias on the sheet member while causing the force exerted on the sheet member to be primarily in the vertical direction. In order to accomplish this, it is preferable to provide a support member having a surface to which the sheet member is secured at its lower extremity and an aperture above the surface through which the sheet member extends. The opposed walls of the aperture diverge from top to bottom to allow flexing of the sheet member.

The rear wall of the aperture is preferably curved so that as the chair rocks rearwardly, the sheet member will engage the curved wall at a higher and higher point, thus progressively decreasing the effective length of the resilient sheet member.

The lower surface to which the sheet member is secured to preferably a flat surface inclined to the vertical at an angle corresponding to the desired inclination of the strip.

The front wall of the aperture in the support member is preferably inclined forwardly with respect to the vertical to facilitate forward rocking of the chair.

Various other features of the invention will be apparent from a consideration of the accompanying specification, claims and drawing.

DETAILED DESCRIPTION OF THE PREFERRED EMBODIMENT

Figure 1:
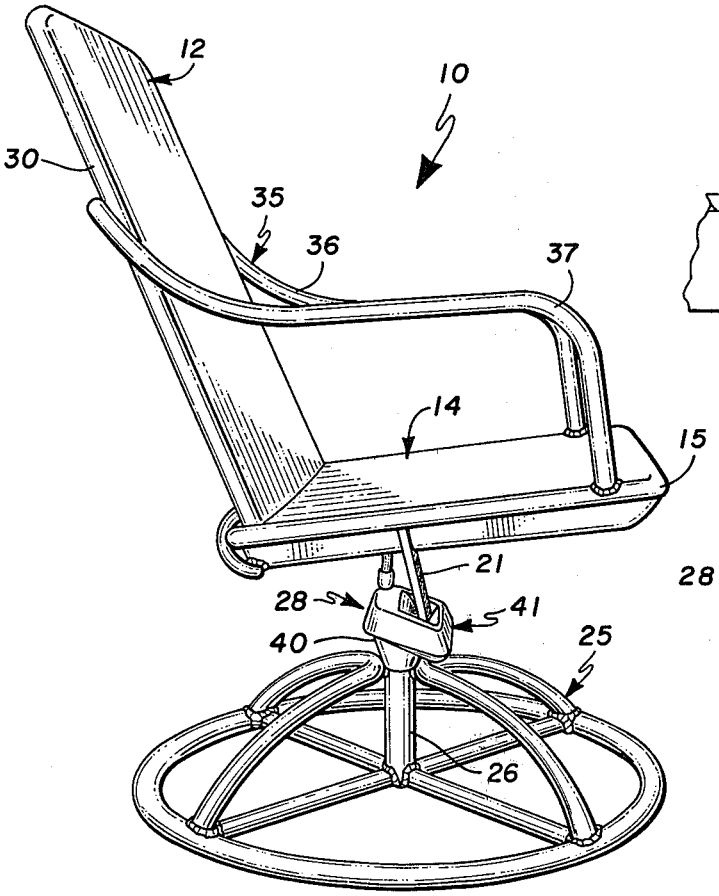
FIG. 1 is a perspective view of the improved rocking chair of the present invention.
Figure 3:
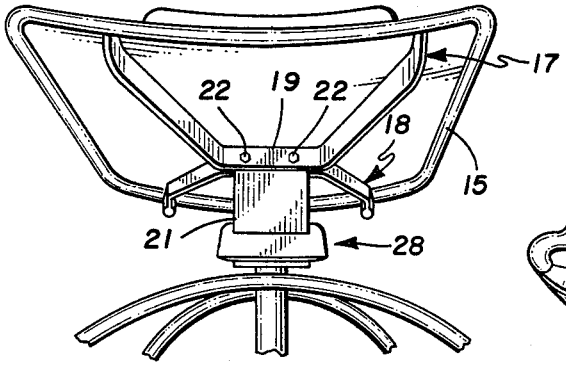
FIG. 3 is a fragmentary view looking from the front of the chair at the bottom of the chair seat and the connection of the chair seat to the base of the chair.
Figure 2:
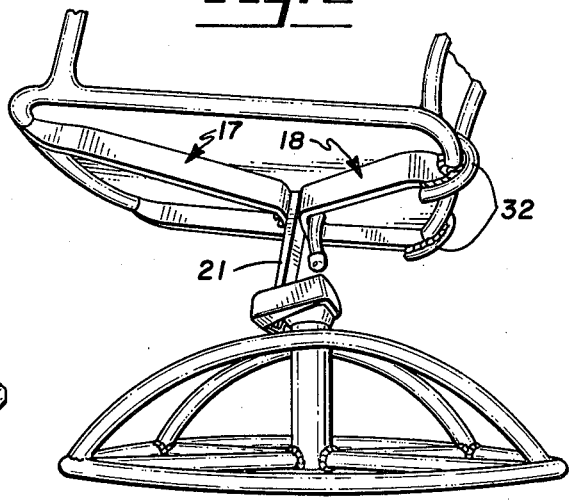
FIG. 2 is a fragmentary view looking at the chair base and chair seat from one side and looking slightly upwardly at the bottom of the chair seat.
Figure 4:
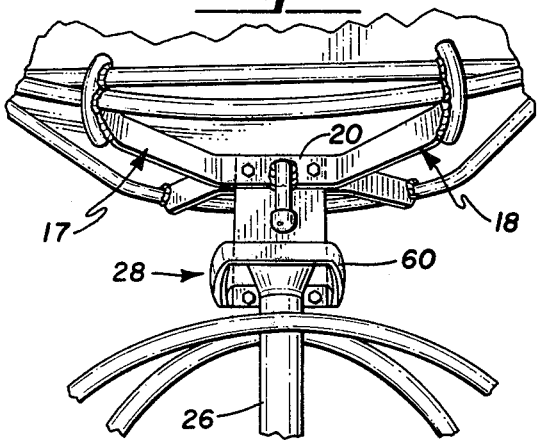
FIG. 4 is a view similar to FIG. 3 but looking at the underside of the chair seat from the rear.

FIG. 1 shows a perspective view of a preferred embodiment of the rocking chair of the present invention. The rocking chair includes a chair portion 10 having a chair back portion 12 and a chair seat portion 14. As best shown in FIGS. 2, 3 and 4, the chair seat portion is supported by a tubular member 15 bent to conform with the desired peripheral configuration of the chair. The ends of the tubular member are suitably secured together as by welding. Secured to tubular member 15 are two generally U-shaped bracket members 17 and 18. These two U-shaped bracket members 17 and 18 are each provided with a base portion and two diverging arms. In the case of bracket 17, the base portion is designated by the reference numeral 19 and that of bracket 18 by the reference numeral 20. Clamped between the two base portions 19 and 20 is the upper end of a flexible strip 21 which supports the chair 10, as will be described in more detail. The bases 19 and 20 and the upper end of strip 21 are clamped together by any suitable clamping means such as nuts and bolts 22.

Referring to the strip 21, this strip is formed of a flexible resilient material which may be a fiber reinforced plastic material, the reinforcing fibers preferably consisting of continuous glass filaments. Such a material is described in the Ward U.S. Pat. No. 4,141,530. In one particular embodiment of the invention, I found it desirable to employ a strip 4 inches wide and $7\frac{1}{4}$ inches long. This can, however, of course be varied, depending upon the extent of the material which is allowed to bend freely and various other factors. As described in the aforesaid Ward U.S. Pat. No. 4,141,530, a typical strip of this type should have a compressive strength of at least 350,000 kPa (kiloPascals) and a flexural strength of at least 350,000 kPa in the lengthwise direction. The flexural modulus should be between 13 to $55\times10^6$ kPa. While the glass filaments are primarily linearly aligned and extend longitudinally of the strip, it is desirable that there also be crosswise fiber reinforcement to prevent the strip 21 from spreading under torsional stress such as may be incurred when a person seats himself from an angle in the rocking direction.

Referring back to the general structure of the chair, the chair 10 is supported from a base 25 which may be any of a variety of forms. As shown, the chair base is formed of a number of tubular members welded together and supporting a vertical center post 26. Pivotally supported on this vertical center post 26 is an apertured support member 28 which forms an important part of may invention and which will be discussed in detail. Basically, the apertured support member 28 is rotatably supported on post 26. The center post 26 is preferably hollow, at least at its upper end, and the support member 28 preferably has a post projecting downwardly into the hollow center post 26 so as to be rotatable therein to provide a rotatable support for support member 28. A bearing member 29 is interposed between member 26 and 28 to permit free rotation of the support member 28 about the axis of the post 26. The lower end of the resilient strip 21 is supported by this support member 28 as will be described in more detail.

As previously indicated, the chair is provided with a chair back 12 supported on a curved tubular frame member 30 which is formed to conform with the desired configuration of the chair back 12. The frame 30 of the back is secured to the frame member 15 of the seat in any suitable manner as by welding and by curved bars 32 which are welded to the lower portion of the back frame member 30, to the seat frame member 15, and to the U-shaped brackets 18, as best shown in FIG. 2. The chair is further provided with an arm rest member 35 formed of a tubular member which is bent to form two arm rests 36 and 37, each of which are curved downwardly and welded to the tubular frame member 15 of the chair seat at their forward ends. The tubular member forming the arm rest is a continuous member which has a base portion extending in back of the frame member 30 of the back and is welded thereto. The arm rest member 35 thus serves not only to provide arm rests 36 and 37 but also to further support the chair back support member 30. The details of the chair back, the chair base, and the arm rest support 35 are not critical to the invention and may take various forms. One particular embodiment has been illustrated, however, for purposes of illustration of how these members may be formed.

Turning now to the manner in which the flexible strip 21 is supported and supports the chair 10, the manner in which the strip 21 is secured to the chair 10 has already been referred to. In other words, it is clamped between the bases 19 and 20 of the U-shaped bracket members 17 and 18. The lower end of the strip 21 is secured to the support member 28, as has been referred to.

Figure 7:
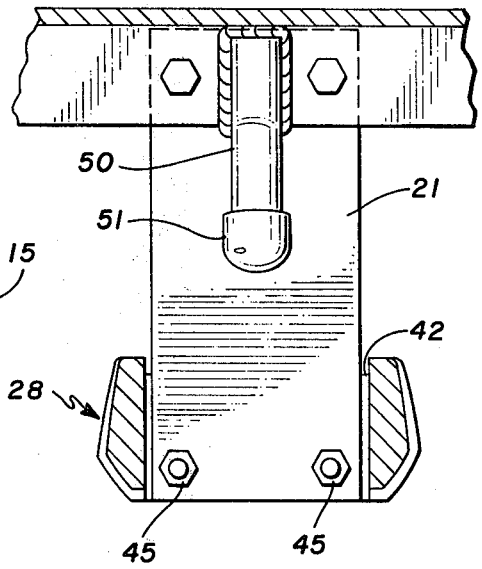
FIG. 7 is a fragmentary sectional view taken along the line 7—7 of FIG. 5 in the direction of the arrow adjacent that line.
Figure 8:
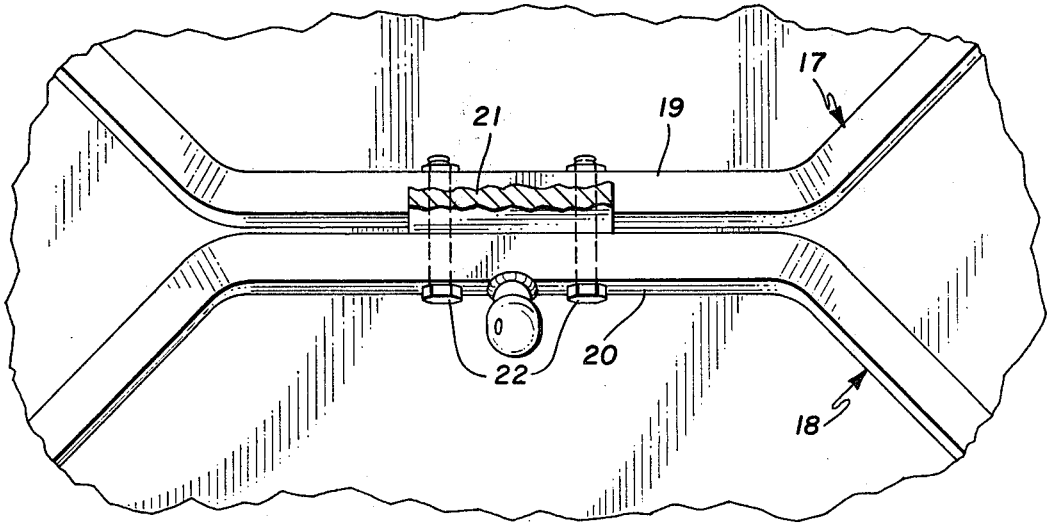
FIG. 8 is a fragmentary view looking upwardly at the bottom of the chair seat as viewed from the line 8—8 of FIG. 5 and in the direction of the arrows.
Figure 5:
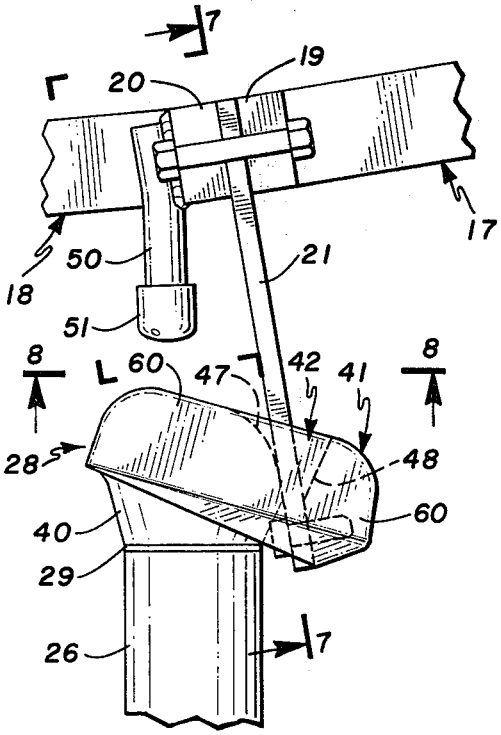
FIG. 5 is a fragmentary view showing in detail the manner in which the flexible strip is secured to the novel mounting means and to the chair base.

Referring specifically to the support member 28, it will be noted that this member comprises a generally frusta-conical base 40 and an enlongated head 41 having an aperture 42 therethrough. The aperture, as best shown in FIG. 7, is slightly wider than the strip 21 so that the strip 21 can extend therethrough. Extending beneath the aperture 42 is an inclined wall 44 to which the lower end of strip 21 is secured by any suitable fastening means such as cap screws 45. The wall 44 determines the inclination of the strip 21 which desirably is between 5 and 15 degrees. An optimum angle has been found to be approximately 10°. This results, as best shown in FIGS. 1, 2 and 5, in the strip 21 being inclined slightly rearwardly when the strip is in a non-stressed position. This means that a slight bias to the rear is imposed on strip 21 so that normally, when an occupant occupies the chair, the strip tends to move to the rear. The advantage of this is discussed in the pending application of Donald L. Bottemmiller and John K. Miles, Ser. No. 164,824, filed June 30, 1980, assigned to the same assignee as the present application, and referred to above. As discussed in that application, by providing a slight bias to the rear, the rocking motion to the rear is initially firmer. If the strip 21 extended vertically, for example, there would be a range of instability in which the chair seat could readily move in either direction. At the same time, it is desirable that the angle of inclination not be too great since otherwise, the action of the strip becomes rather "soft". The U-shaped brackets 17 and 18 can be formed so that the base members 19 and 20 also extend at this angle when the chair is in the normal non-rocking position shown in FIG. 1, as best shown in FIGS. 2 and 5.

Referring again to the lower support member 28, the aperture 42 is bounded on the rear by a curved wall 47 and in the front by an inclined wall 48. As clearly evident from FIGS. 5 and 6, the wall 47 is curved over a major portion of its extent. The curved wall 47, as best shown in FIG. 6, results in the free portion of strip 21 being shortened as the chair rocks backwardly.

To limit the rearward movement of the chair and prevent the chair seat from being tilted back to the point where the chair becomes unstable, I provide a stop member in the form of a downwardly extending bar 50 which has its upper end rigidly secured to the base 20 of the U-shaped bracket 18, as by welding, as best shown in FIGS. 4 and 5. The lower portion of stop bar 50 is curved rearwardly to minimize the angle of this lower portion of the bar with respect to vertical when the chair seat is in its most rearward position (shown in FIG. 6). The lower end of the bar 50 is provided with a cushioning cap 51 which is designed to actually engage the top of the lower support member 28. Thus, as the chair is rocked rearwardly, the stop member 50 will engage the upper end of the lower support member 28 to stop further movement.

Figure 6:
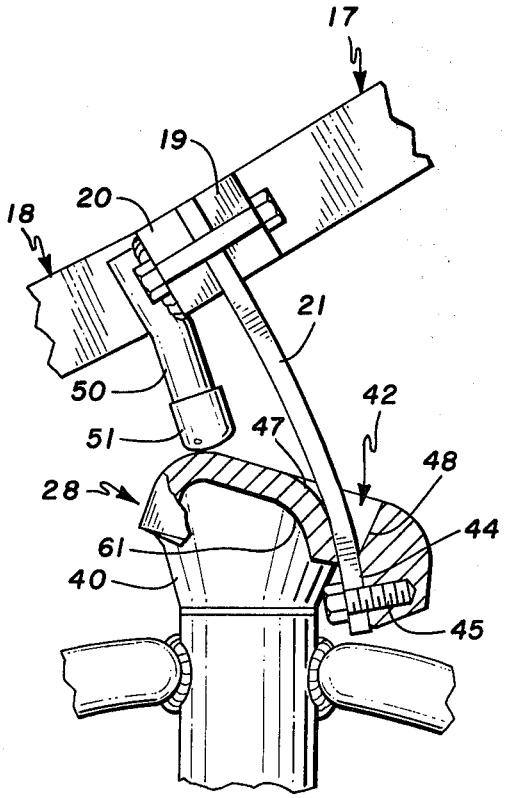
FIG. 6 is a view similar to FIG. 5 but showing the novel mounting means partly in section and with the chair inclined rearwardly to the limit of its rearward rocking movement.

The length of the stop member 50 and the curvature of the rear surface 47 are so related that when the stop member 50 is engaging the top of the support member 28, the strip is still engaging the curved surface 47 but the distance between the portion of the strip 21 engaging the curved surface 47 and the portion where it is clamped between base portions 19 and 20 of brackets 17 and 18, as shown in FIG. 6, is substantially less than when the chair is in the relaxed position shown in FIG. 5. In other words, as the chair rocks rearwardly, the "free portion" of strip 21 progressively decreases in a controlled manner determined by the curvature of the rear surface 47. This is highly desirable since the force required to rock the chair is dependent upon the length of the free portion of strip 21 which is not engaging either the upper or lower support members. Obviously, the longer the free portion of the strip is, the easier the chair will flex rearwardly. By progressively shortening the length of the strip 21, it is possible to progressively increase the force necessary to rock the chair as the chair moves to the rear. As will be obvious from a comparison of FIGS. 5 and 6, this progressive change in the length of the free portion of the strip occurs over a substantial change in the angle of the chair seat.

The front wall 48 of aperture 42 is inclined forwardly. This permits the chair to rock forwardly somewhat. If the chair is rocked sufficiently forwardly to cause the strip 21 to engage a substantial portion of the wall 48, the force required to rock the chair is greatly increased. In actual practice, however, the chair will not be rocked forwardly this much.

As has been mentioned previously, the slot 42 is relatively long in order to accommodate the full width of the strip 21, as shown in FIG. 7. In order to provide for such a long slot and not unduly increase the weight of the lower support member 28, the upper portion 41 of the support member 28 is formed as a generally rectangular box as best shown in FIGS. 1 and 4. In other words, the upper portion has a downwardly extending lip 60 which surrounds the rear part of the upper portion 41. Inasmuch as the center part of the upper portion 41 is formed as a continuation of the solid frustoconical lower portion 40, this will provide adequate support for resisting the bending action of the strip 21. In other words, the curved surface 47 is formed in part by a downwardly curved hollow lip 61 but also by a curved portion of the upper part of the frustoconical base member 40 of the lower support member. In this way, I have provided for a firm support of the strip 21 without unduly adding to the mass of the lower support 28 as would occur if the lower support member were formed of a solid block of material.

CONCLUSION

It will be seen that I have provided an improved chair construction in which it is possible to obtain the advantage of the very simple rocking action provided by the use of a flexible plastic sheet means but in which the chair is extremely stable by reason of the rocking force required being progressively increased as the chair is moved to the rear. This is done with an extremely simple construction which adds a minimum of weight to the over-all chair. Furthermore, I have provided for a very stable chair in which the chair is always biased somewhat to the rear to place an initial tension upon the plastic material. This is also accomplished in an extremely simple manner.

While I have shown a specific embodiment of my invention, it is to be understood that this is for purposes of illustration only and that the scope of the invention is limited solely by that of the appended claims.

What I claim is:

1. A rocking chair comprising:

a chair base;

a chair;

flexible plastic sheet means connected between the chair base and the chair for supporting the chair and its occupant and permitting rocking of the chair with respect to the base in a plane essentially normal to a major surface of the flexible sheet means by flexing of the flexible plastic sheet means;

first mounting means for connecting one end of the flexible sheet means to the chair, second mounting means for connecting an opposite end of the flexible sheet means to the chair base, the flexible sheet means extending generally upwardly from the second mounting means to the first mounting means at a slight inclination rearwardly from a vertical position when the chair is unoccupied so that the chair and its occupant initially apply a primarily compressive load to the flexible plastic sheet means, said second mounting means comprising a support member secured to and above the chair base and having a lower generally flat upwardly extending surface and an aperture extending through said support member above said flat surface, said aperture being of a width at least equal to that of the flexible sheet means and with the opposed walls of said aperture diverging from the bottom to the top of the aperture, the rear wall of the aperture being curved to provide a controlled decrease in the free length of the sheet means as the chair is rocked rearwardly, and means for fastening the lower end of the sheet means to said flat surface at the slight inclination to the vertical with the sheet means extending upwardly through said aperture towards the first mounting means, and stop means for stopping the rearward movement of the chair before the sheet means engages the upper end of said curved wall.

2. The chair of claim 1 in which the lower flat, upwardly extending surface is inclined to the vertical at an angle corresponding to said desired slight inclination.

3. The chair of claim 1 in which the angle of such slight inclination when the chair is unoccupied is between approximately 5° and 15°.

4. The chair of claim 1 in which the angle of such slight inclination when the chair is unoccupied is approximately 10°.

5. The chair of claim 1 in which said support member is swivelly secured to the chair base so that the chair can be swivelled as well as rocked with respect to the chair base.

6. The chair of claim 1 in which the front wall of the aperture of the support member is inclined forwardly with respect to the vertical to facilitate forward rocking of the chair.

7. The chair of claim 1 in which the plastic sheet means is in the form of a flat fiber-reinforced plastic spring.

8. The chair of claim 1 in which the reinforcing fibers comprise continuous glass filaments.

9. The chair of claim 1 in which the upper portion of said support member through which said aperture extends is of a generally rectangular configuration.

10. The chair of claim 1 in which the sheet means is fastened to the flat surface by a plurality of screw threaded fasteners.

* * * * *